US006272836B1

(12) United States Patent
Fat

(10) Patent No.: US 6,272,836 B1
(45) Date of Patent: Aug. 14, 2001

(54) ADJUSTABLE LINKAGE FOR A WATCHBAND

(75) Inventor: Cheung Yat Fat, Tuen Mun (HK)

(73) Assignee: Timex Corporation, Middlebury, CT (US)

( * ) Notice: Subject to any disclaimer, the term of this patent is extended or adjusted under 35 U.S.C. 154(b) by 0 days.

(21) Appl. No.: 09/627,459

(22) Filed: Jul. 28, 2000

Related U.S. Application Data

(60) Provisional application No. 60/173,652, filed on Dec. 30, 1999.

(51) Int. Cl.[7] ..... F16G 15/04
(52) U.S. Cl. ..... 59/80
(58) Field of Search ..... 59/80, 82, 85; 63/4

(56) References Cited

U.S. PATENT DOCUMENTS

| | | | | |
|---|---|---|---|---|
| 1,939,346 | | 12/1933 | Green . | |
| 2,699,035 | | 1/1955 | Becker . | |
| 3,726,083 | * | 4/1973 | Pompeo | 59/80 |
| 3,837,163 | * | 9/1974 | Fujimoro | 59/80 |
| 3,930,364 | * | 1/1976 | Wong | 59/80 |
| 3,976,233 | | 8/1976 | Cobelli . | |
| 4,051,668 | * | 10/1977 | Learn | 59/80 |
| 4,269,026 | * | 5/1981 | Bulle et al. | 59/82 |
| 4,414,714 | | 11/1983 | Kostanecki . | |
| 4,644,611 | | 2/1987 | Tanaka . | |
| 4,653,933 | | 3/1987 | Reichel . | |
| 4,689,860 | | 9/1987 | Suchowski . | |
| 4,819,306 | | 4/1989 | Kasai . | |
| 5,483,505 | | 1/1996 | Cartier . | |
| 5,737,809 | | 4/1998 | Driver . | |
| 6,098,394 | * | 8/2000 | Hashimoto | 59/82 |
| 6,101,842 | * | 8/2000 | Delacretaz | 63/4 |

* cited by examiner

*Primary Examiner*—David Jones
(74) *Attorney, Agent, or Firm*—Carmody & Torrance LLP

(57) ABSTRACT

A removable link for use in an arrangement comprising a plurality of interlocking links is provided. In a preferred embodiment, the removable link is used in a watchband and preferably comprises a link body having a first end and a second end; a hand portion having a bar receiving region formed at the first end of the body; a bar coupled to the second end of the body, for coupling to the decoupling link; a retractable retaining pin having a first end within the link body and a second end extending from the link body into the bar receiving region, the retractable retaining pin being slideable within a bore provided in the link body, the retaining pin for retaining a retainable bar in the bar receiving region and a biasing member, coupled to the retaining pin, for biasing the retaining pin towards the bar receiving region; whereby the retainable bar is retained within the bar receiving region by the retaining pin, and where the retainable bar is decoupled from the removable link by causing the retracting of the retaining pin away from the bar receiving region sufficiently to allow the retainable bar to be removed therefrom.

12 Claims, 3 Drawing Sheets

ADJUSTABLE LINKAGE FOR A WATCHBAND

RELATED U.S. APPLICATION DATA

This application claims the benefit of U.S. Provisional Application No. 60/173,652, filed Dec. 30, 1999.

BACKGROUND OF THE INVENTION

The present invention relates generally to watchbands, and in particular, to an improved adjustable watchband that provides for removal and insertion of individual links within a watchband without the need of special coupling or decoupling tools.

Generally speaking, the watchband links themselves or the watchband/watchhead casing are connected together by the use bars or springbars, respectively, or other assembly constructions that permit the attachment or detachment of individual links within the watchband, or permit the attachment or detachment of the watchband to the watchhead casing. This enables a wearer to adjust the length of the wristband to accommodate the size of the wearer's wrist, as the length of the desired watchband (i.e. the tightness about one's wrist) will vary from user to user, or from time to time.

Many such attempts to provide for easy coupling and decoupling of links, for watchbands or other devices, are known. For example, U.S. Pat. No. 3,976,233 describes a wristwatch strap and the use of resilient loops in which adjacent link ends may be axially introduced. U.S. Pat. No. 1,939,346 describes the use of a hook $a^2$ and bar $a^3$ arrangement for coupling the links, wherein the use of notches $a^4$ permit the slidability of the bar into corresponding hooks. U.S. Pat. No. 2,699,035 describes yet another example of an ornamental chain for bracelets in which the individual links may be connected or disconnected.

However, the foregoing constructions do not provide the ease with which one may desire to remove individual links while at the same time providing the desired security that the links will not inadvertently become detached.

Accordingly, it is desirable to provide a watchband construction for a wristworn timepiece and/or wrist instrument, such as a watch, that overcomes the above-identified deficiencies and achieves the above and below-identified objectives.

SUMMARY AND OBJECTS OF THE INVENTION

Generally speaking, in accordance with the present invention, a removable link for use in an arrangement comprising a plurality of interlocking links is provided. In a preferred embodiment, the removable link is used in a watchband and preferably comprises a link body having a first end and a second end; a hand portion having a bar receiving region formed at the first end of the body; a retractable retaining pin having a first end within the link body and a second end extending from the link body into the bar receiving region, the retractable retaining pin being slideable within a bore provided in the link body, the retaining pin for retaining a retainable bar in the bar receiving region; and a biasing member, coupled to the retaining pin, for biasing the retaining pin towards the bar receiving region; whereby the retainable bar is retained within the bar receiving region by the retaining pin, and where the retainable bar is decoupled from the removable link by the retracting of the retaining pin away from the bar receiving region sufficiently to allow the retainable bar to be removed therefrom.

The link body may include integrally formed, spaced apart first and second shoulders between which a bar is secured between. The removable link is preferably decoupled from the decoupling link by decoupling the bar of the removable link from a bar retaining region of the decoupling link. The retainable bar may be part of another one of the plurality of interlocking links or may be a springbar coupled between a pair of lugs which themselves are part of a watch casing.

In another preferred embodiment, an arrangement comprising a plurality of interlocking links is provided. Here, the arrangement comprises at least one removable link and at least one decoupling link. The removable link preferably comprises a link body, a hand portion having a bar receiving region formed at a first end of the body; a bar coupled to a second end of the body; a retractable retaining pin having a first end within the link body and a second end extending from the link body into the bar receiving region, the retractable retaining pin being slideable within a bore provided in the link body, the retaining pin for retaining a retainable bar in the bar receiving region; and a biasing member, coupled to the retaining pin, for biasing the retaining pin towards the bar receiving region. In a similar manner, the decoupling link comprises a link body having a first end and a second end; a hand portion having a bar receiving region formed at the first end of the body; a retractable retaining pin having a first end within the link body and a second end extending from the link body into the bar receiving region, the retractable retaining pin being slideable within a bore provided in the link body, the retaining pin for retaining the bar of the removable link in its bar receiving region; and a biasing member, coupled to the retaining pin, for biasing the retaining pin towards the bar receiving region. In this construction, the first end of the removable link is decoupled from the arrangement by causing the retainable bar to be decoupled therefrom by retracting the retaining pin thereof away from the bar receiving region sufficiently to allow the retainable bar to be removed therefrom, and further whereby the second end of the removable link is decoupled from the decoupleable link by causing the bar of the removable link to be decoupled from the decoupling link by retracting the retaining pin of the decoupling link away from the bar receiving region of the decoupling link sufficiently to allow the bar of the removable link to be removed therefrom. This arrangement may include a plurality of removable links and also be part of a watchband that may also be comprised of fixed, removable links that require a tool for further adjustment as well as the above described removable links, (i.e. no tool needed for decoupling).

Accordingly, it is an object of the present invention to provide an improved watchband for a wristwatch that permits easy linking and delinking of individual links within the watchband, all without the need to use a special tool or device therefor.

Another object of the present invention to provide an improved watchband in which the removable link(s) are not visible from the upper surface of the watch (i.e. when on a user's wrist).

Yet another object of the present invention is to provide an improved watchband in which the link configuration conforms to the shape of the existing watchband design.

Still another object of the present invention is to provide an improved watchband in which the removable link(s) have the same function (i.e. movement and integration) as the non-removable links which make up the remaining interlocking links of the watchband.

Yet another object of the present invention is to provide an improved watchband in which the removable link can be removed by hand.

Still another object of the present invention is to provide an improved watchband that can incorporate a plurality of removable links.

Yet another objective of the present invention is to provide an improved interlocking link arrangement that can be utilized for bracelets, necklaces and other devices where adjustability is desired.

In yet another advantage, the present invention can be used so as to interchange various watchheads with the interlocking link arrangement disclosed herein.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

These and other objects and features of the present invention will become clear from the following description taken in conjunction with the preferred embodiments thereof with reference to the accompanying drawing, in which.

Like reference numerals in the figures represent like parts.

DETAILED DESCRIPTION OF THE PREFERRED EMBODIMENTS

Figure 1:
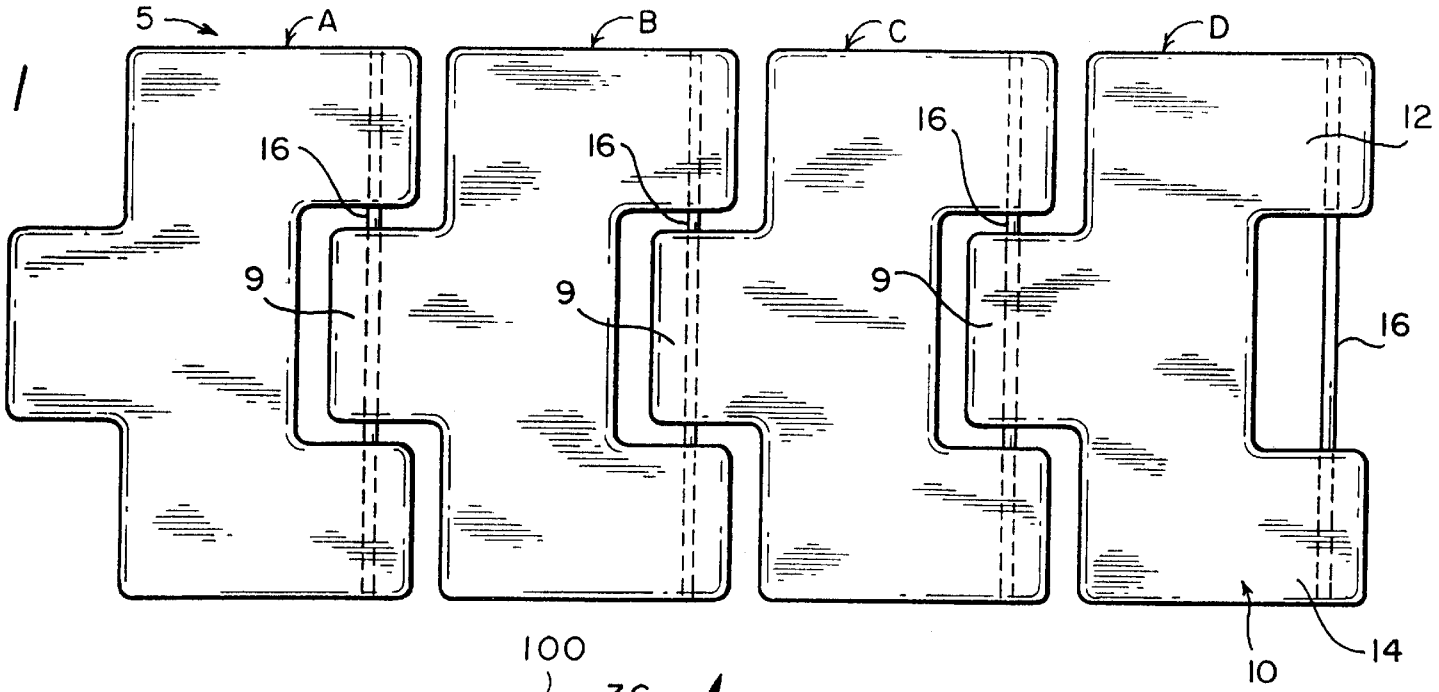
FIG. 1 is a bottom plan view of a plurality of interlocking links constructed for use in a watchband or other interlocking link arrangement constructed in accordance with the present invention.

Reference is first made to FIG. 1, which illustrates a plurality of interlocking links, which, in the preferred embodiment, form part of a watchband, generally indicated at 5, constructed in accordance with the present invention. In particular, illustrated in FIG. 1 are individual links A, B, C and D. Particular reference hereinafter will be made to link D, it being understood that links A, B and C are all preferably constructed similarly. Link D is preferably comprised of a body, generally indicated at 10, having integrally formed shoulders 12, 14 with a bar 16 positioned therebetween. The manner in which bar 16 is fixedly secured within and between shoulders 12, 14 of link 14 is well known in the art. Each bar 16 permits each respectively adjacently coupled link to rotate thereon in a known manner. For example, link C is rotatably coupled to link D, link B is rotatably coupled to link C, etc.

To achieve this coupling, each link A, B, C and D includes a head 9 with an aperture therethrough, though which each respective bar 16 of one adjacent link is rotatably secured. FIG. 1 illustrates the underside of links A, B, C and D, although it should be understood that the top side of links A, B, C and D may appear similar and may include additional ornamentation for aesthetic purposes forming no part of the invention, but discussed in further detail below with reference to FIG. 6. It should be understood that links A–D are constructed not to be removable from watchband 5.

Figure 2:
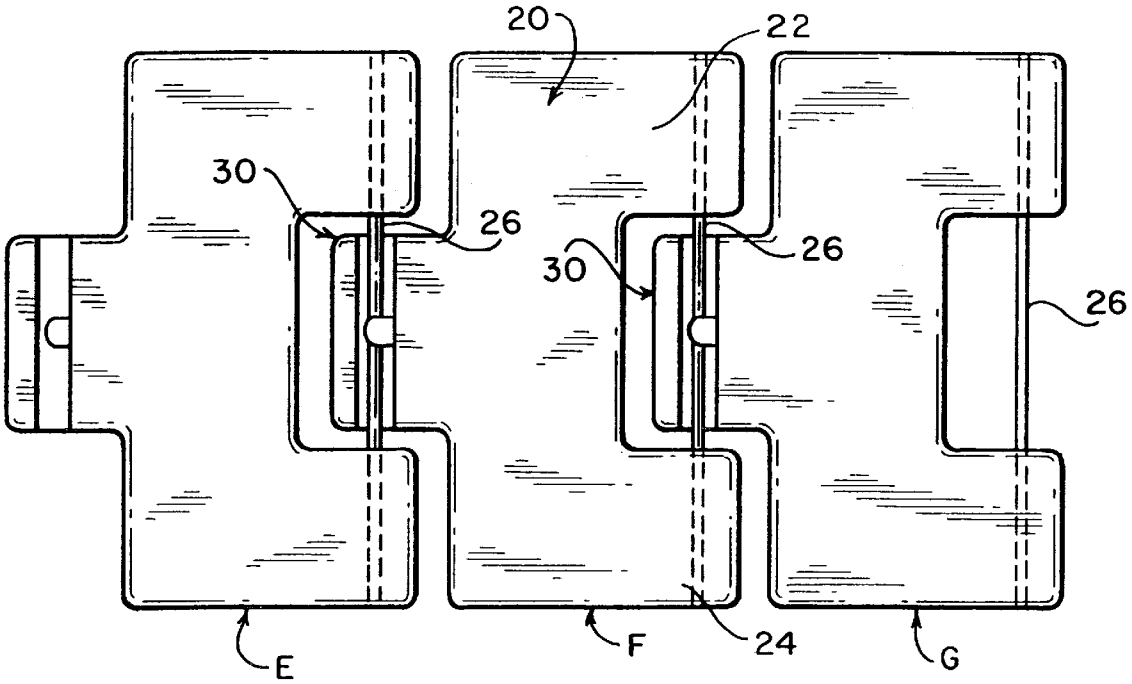
FIG. 2 is a bottom plan view of a plurality of other interlocking links, for a watchband or other interlocking link arrangement, constructed in accordance with the present invention, two of which are coined a "removable link", and the third of which, coined a "decoupling link", is also constructed in accordance with the present invention.

Reference is now made to FIG. 2, which illustrates a plurality of additional interlocking links forming a second portion of watchband 5. In particular, illustrated in FIG. 2 are links E, F and G, with particular reference now being made to link F, as it is constructed in accordance with the present invention. Links E and G are preferably constructed similarly to link F. Hereinafter, links E and F shall be coined a "removable link" and link G shall be coined a "decoupleable link".

Link F is preferably comprised of a body, generally indicated at 20, having a first end and a second end. At the second end are integrally formed shoulders 22, 24 with a bar 26 positioned therebetween. The manner in which bar 26 is fixedly secured within and between shoulders 22, 24 is in a similar manner to bar 16 of links A–D of FIG. 1. At the first end of link F is a hand portion, generally indicated at 30, which extends from and is preferably integral with body 20. As should be now understood, hand portion 30 of link F is constructed to receive bar 16 of for example, link D and/or a bar 26 of link E. Any bar 16 or any bar 26 shall be coined the "retainable bar" as it is a bar retainable in the hand region. Also deemed a "retainable bar" is a springbar on a watchhead such as that in U.S. Pat. No. 4,653,933, incorporated by reference as if fully set forth herein. In a similar manner, hand portion 30 of link G is constructed to receive therein bar 26 (i.e. the retainable bar) of link F. For completeness, if a second removable link (i.e. link E) is present, it may instead be coupled to link D in the manner disclosed below.

Figure 3:
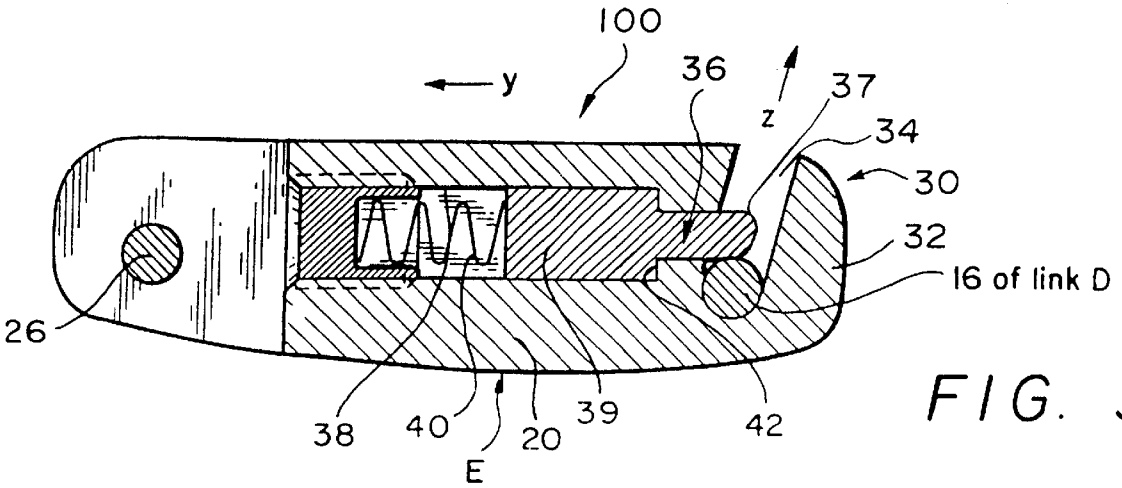
FIG. 3 is a cross-sectional view of a removable link constructed in accordance with the present invention taken, also illustrating a retainable bar of an adjacent link.

Reference is now made to FIG. 3 which illustrates, from a cross-sectional view, the preferred construction of links E, F and G. Hand portion 30 includes a finger-extending member 32 extending from body 20 so as to form a gap, or bar receiving region 34. Extending into gap 34 is a retractable retaining pin 36. Pin 36 includes a head 37 which extends into gap 34, and a body 39 which is retained in a bore 38 within body 20. Pin 36 is slideable within bore 38 and biased towards gap 34 by a spring member 40. Spring member 40 and pin 36 may be inserted through the back of body 20 via a hole formed therein towards the second end thereof. Once pin 36 is inserted into bore 38, spring 40 is inserted behind pin body 39. Spring 40 rests flush to the back of pin body 39, and thus needs no permanent securing thereto, as spring 40 needs only to mate flush to pin body 39 and is kept from moving by the fit within the bore 38. The second end of spring member 40 is trapped in place by a screw retainer pin, or plug, that can fit into body 20 and retains the spring member within the bore. Such a plug is shown by reference numeral 99 in FIG. 5. It is this configuration, a linear bore drilled from the backside of body 20 that allows assembly of the pin body and spring member within the bore and into the link. After this assembly, bar 26 may then be driven in place in a known manner. Inner wall surfaces 42 in bore 38 help prevent retaining pin 36 from sliding out of bore 38 or from overextending into gap 34. Pin 36 may be compressed inwardly deeper within bore 38 against the biasing of spring member 40 as described below.

The appreciation of a rounded head 37 permits the direct biasing of pin 36 within bore 38, as will now be described. That is, force upon pin 36 within and out of gap 34 includes a horizontal component in the "y" direction (and that opposite to the "y" direction) will cause pin 36 to retract within bore 38 in the manner described below, and upon the passing of a bar below or above pin 36 pin 36 will again spring forward into gap 34 by way of the spring member 40 contained within bore 38 of link E thus retaining a bar therein.

Figures 4, 5:
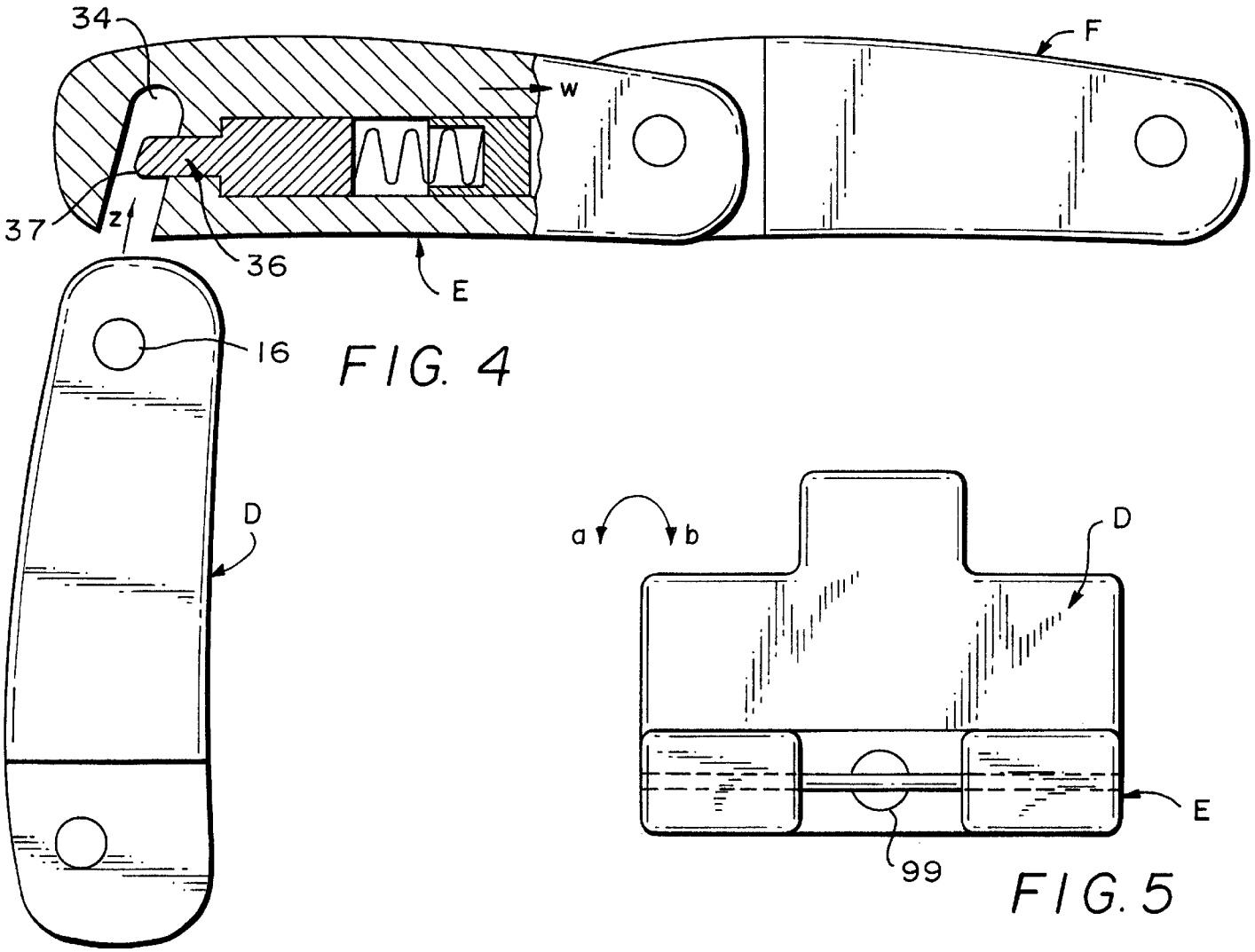
FIG. 4 is a side view of the removable link of FIG. 3 and one of the links of FIG. 1.
FIG. 5 is an end view of the links illustrated in FIG. 4.

In operation, and with particular reference made to FIG. 4, bar 16 of link D (or a springbar of a watchhead) is preferably slidably forced (in the direction of arrow "z") passed the rounded end of head 37 of pin 36 of link E. Pin 36 is compressed inwardly (in the direction of arrow "w") as bar 16 of link D passes thereby, but is once again biased outwardly into gap 34 once bar 16 has cleared head 37 of pin 36. In this way, bar 16 of link D (or pin 26 of a removable link) is securely and yet releasably retained within gap 34 of link E.

More specifically, to insert link D into link E, links D and E are preferably rotated relative to each other so as to be perpendicular thereto, as illustrated in the simplistic diagram of FIG. 4. By then lightly forcing links D and E together, pin 36 will compress so as to allow bar 16 to pass thereby. Upon the clearing of bar 16 passed pin 36, pin 36 will securely retain bar 16 within gap 34.

To detach link D (or a springbar of a watchhead or other removable link) from link E, link D may be, but not necessarily, rotated relative to link E as shown in FIG. 4, and thereafter, slightly rotated (in the direction of arrows "a" or "b") relative to link E as illustrated in FIG. 5, thus causing the decoupling of the links, as the pulling action of link D away from link E as illustrated causes bar 16 of link D to move out of gap 34 of link E, first contacting the end of pin 36 and thereby compressing pin 36 so as to allow bar 16 to pass thereby. Upon the clearing of bar 16 relative to pin 36, link D, and all links still coupled thereto, are hence decoupled from link E. Shown in FIG. 4 for illustrative purposes is bar 26 of link E within gap 34 of link F. Of course, the links may be decoupled without providing any rotation in either the "a" or "b" direction (FIG. 5) or perpendicularly, as shown in FIG. 4. That is, merely pulling link D away from link E in a direction opposite arrow "z" (without rotation) would also work.

In the figures and as stated above, in the preferred embodiment, link G is coined the "decouplable link" because, in the most simple of interlocking link arrangements, link F is entirely removable from watchband 5 while link G is assured to be coupled to a non-removable link. For example, bar 26 of link G may be coupled to a link constructed similarly to link C. However, bar 26 of link F must also be releasable from bar retaining region 34 of link G. For this reason, link G includes a hand region, spring member, retaining pin and retractor preferably identical to link F. With link E absent, only one removable link (i.e. "F") is shown in FIG. 2 although the arrangement contemplates more removable links being utilized, such as in FIG. 6.

Figure 6:
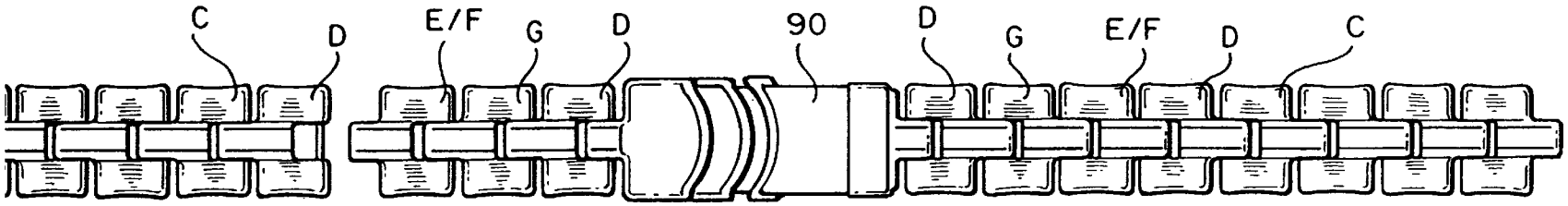
FIG. 6 is a top plan view of the interlocking link arrangement which may be a watchband by way of illustration, and not limitation, constructed in accordance with the present invention, some of the links being detached to more particularly highlight the features, structure, advantages and functions thereof.

To summarize the foregoing, reference is now made to FIG. 6 which is a top plan view of watchband 5 more completely assembled and highlighting the aforementioned aspects and features of the present invention. Specifically, watchband 5 is comprised of a plurality of links, not all of which are removable. In particular, not every link need be removable. Such a construction will reduce the manufacturing cost, and is most practical in that no more a few links ever need to be removed at one time, although a wristband in which every link is removable is within the scope of the invention.

As shown in FIG. 6, links C, D, E, F, and G (and those links respectively identical thereto) are specifically highlighted, as it is shown that it is preferable to have an equal number of removable links on either side of a clasp 90, since for symmetry, it may be desirable to remove an equal number of links on each side of the clasp 90. In the disclosed example, a metal foldover buckle (clasp) 90 is used. A wristband using this type of clasp can easily take advantage of the present invention. Removing only one removable link at a time is easily contemplated hereby. FIG. 6 illustrates how, from the top plan view, it is at least difficult to determine which links are removable. Multiple removable links on either side of clasp 90 is preferred to provide maximum flexibility to a user.

Still further, while the present invention is disclosed most preferably with regard to watchbands, the present invention could also be use for bracelets, necklaces or any other device that could appreciate the adjustability of the interlocking link arrangement of the present invention.

While the invention has been particularly shown and described with respect to preferred embodiments thereof, it will be understood by those skilled in the art that changes in form and details may be made therein without departing from the scope and spirit of the invention.

For example, the material of the links is one of design choice and may be comprised of metal, steel, plastic, combinations or forms thereof, and may include brass, stainless steel, alloys, titanium, aluminum, composites, or the like. The spring may be a common metal spring or made of varying materials, such as PVC, Silicone, Rubber, etc., formed into a cylindrical shape and inserted into the bore as any compressible material trapped in the bore can act as a spring due to the nature of the material.

What I claim is:

1. A removable link for use in an arrangement comprising a plurality of interlocking links, wherein the plurality of interlocking links includes at least one decoupling link that is decouplable from the removable link, the removable link comprising:

a link body having a first end and a second end;

a hand portion having a bar receiving region formed at the first end of the body;

a retractable retaining pin having a first end within the link body and a second end extending from the link body into the bar receiving region, the retractable retaining pin being slideable within a bore provided in the link body, the retaining pin for retaining a retainable bar positioned in the bar receiving region; and a biasing member, coupled to the retaining pin and positioned within the bore, for biasing the retaining pin towards the bar receiving region;

whereby the retainable bar is retained within the bar receiving region by the retaining pin extending into the bar receiving region, and whereby the retainable bar is decoupled from the removable link by the retracting of the retaining pin away from the bar receiving region sufficiently to allow the retainable bar to be removed therefrom.

2. The removable link as claimed in claim 1, wherein the second end of the retaining pin has a surface shape to facilitate the sliding of the retainable bar along the surface of the retaining pin this causing the retaining pin to retract within the bore away from the bar receiving region.

3. The removable link as claimed in claim 1, wherein the link body comprises:

a bar coupled to the second end of the body for coupling to the decoupling link; and integrally formed, spaced apart first and second shoulders;

wherein the bar is secured to and between the first and second shoulders.

4. The removable link as claimed in claim 3, wherein the removable link is decoupled from the decoupling link by decoupling the bar of the removable link from a bar retaining region of the decoupling link.

5. The removable link as claimed in claim 1, wherein the biasing member is a spring.

6. The removable link as claimed in claim 1, wherein the retainable bar is coupled to another one of the plurality of interlocking links.

7. The removable link as claimed in claim 1, wherein the retainable bar is a springbar coupled between a pair of lugs which themselves are part of a watch casing.

8. The removable link as claimed in claim 1, wherein the link body includes inner wall surfaces to prevent the retaining pin from overextending within the bar retaining region.

9. The removable link as claimed in claim 1, wherein the removable link is a link in a watchband.

10. An arrangement comprising a plurality of interlocking links, wherein the arrangement comprises:

at least one removable link comprising:

a link body having a first end and a second end; a hand portion having a bar receiving region formed at the first end of the body; a bar coupled to the second end of the body; a retractable retaining pin having a first end within the link body and a second end extending from the link body into the bar receiving region, the retractable retaining pin being slideable within a bore provided in the link body, the retaining pin for retaining a retainable bar in the bar receiving region; and a biasing member, coupled to the retaining pin, for biasing the retaining pin towards the bar receiving region; and at least one decoupling link that is decouplable from the removable link, the decoupling link comprising:

a link body having a first end and a second end; a hand portion having a bar receiving region formed at the first end of the body; a retractable retaining pin having a first end within the link body and a second end extending from the link body into the bar receiving region, the retractable retaining pin being slideable within a bore provided in the link body, the retaining pin for retaining the bar of the removable link in its bar receiving region; and a biasing member, coupled to the retaining pin, for biasing the retaining pin towards the bar receiving region;

whereby the first end of the removable link is decoupled from the arrangement by causing the retainable bar to be decoupled therefrom by the retracting of the retaining pin away from the bar receiving region sufficiently to allow the retainable bar to be removed therefrom, and further whereby the second end of the removable link is decoupled from the decoupleable link by causing the retracting of the retaining pin of the decoupling link away from the bar receiving region of the decoupling link sufficiently to allow the bar of the removable link to be removed therefrom.

11. The arrangement as claimed in claim 10, including a plurality of removable links.

12. An arrangement of interlocking links for use in a watchband, wherein the arrangement comprises:

at least one removable link comprising:

a link body having a first end and a second end; a hand portion having a bar receiving region formed at the first end of the body; a bar coupled to the second end of the body; a retractable retaining pin having a first end within the link body and a second end extending from the link body into the bar receiving region, the retractable retaining pin being slideable within a bore provided in the link body, the retaining pin for retaining a retainable bar in the bar receiving region; and a biasing member, coupled to the retaining pin, for biasing the retaining pin towards the bar receiving region; and at least one decoupling link that is decouplable from the removable link, the decoupling link comprising:

a link body having a first end and a second end; a hand portion having a bar receiving region formed at the first end of the body; a retractable retaining pin having a first end within the link body and a second end extending from the link body into the bar receiving region, the retractable retaining pin being slideable within a bore provided in the link body, the retaining pin for retaining the bar of the removable link in its bar receiving region; and a biasing member, coupled to the retaining pin, for biasing the retaining pin towards the bar receiving region;

whereby the first end of the removable link is decoupled from the arrangement by causing the retainable bar to be decoupled therefrom by retracting the retaining pin thereof away from the bar receiving region sufficiently to allow the retainable bar to be removed therefrom, and further whereby the second end of the removable link is decoupled from the decoupleable link by causing the retracting of the retaining pin of the decoupling link away from the bar receiving region of the decoupling link sufficiently to allow the bar of the removable link to be removed therefrom.

* * * * *